US006655064B1

(12) United States Patent
Dodson

(10) Patent No.: US 6,655,064 B1
(45) Date of Patent: Dec. 2, 2003

(54) PICTURE FRAME WITH PICTURE AND SHADOWBOX MAT SYSTEM

(76) Inventor: Gregg C. Dodson, 250 Market St., Sanford, NC (US) 27330

( * ) Notice: Subject to any disclaimer, the term of this patent is extended or adjusted under 35 U.S.C. 154(b) by 196 days.

(21) Appl. No.: 09/661,417

(22) Filed: Sep. 13, 2000

(51) Int. Cl.[7] ..... A47G 1/06
(52) U.S. Cl. ..... 40/800; 40/722
(58) Field of Search ..... 40/800, 728, 721, 40/735, 768, 769, 722

(56) References Cited

U.S. PATENT DOCUMENTS

| | | | | | |
|---|---|---|---|---|---|
| 2,125,191 | A | * | 7/1938 | Moore | 40/800 |
| 2,314,721 | A | * | 3/1943 | Lowenstein | 40/800 |
| 2,598,755 | A | | 6/1952 | Birch | |
| 2,903,805 | A | | 9/1959 | Armentrout | |
| 3,382,595 | A | * | 5/1968 | Shore | 40/768 |
| 4,117,613 | A | | 10/1978 | Hosker | |
| 4,153,162 | A | | 5/1979 | Samsing | |
| 4,215,499 | A | | 8/1980 | Wilson | |
| 4,286,400 | A | | 9/1981 | MacPherson et al. | |
| 4,590,696 | A | | 5/1986 | Squitieri | |
| 4,777,745 | A | | 10/1988 | Rose | |
| 4,794,714 | A | * | 1/1989 | Weisgerber | 40/768 |
| 4,939,858 | A | | 7/1990 | Dailey | |
| 4,991,336 | A | | 2/1991 | Lucke | |
| 5,025,579 | A | | 6/1991 | Krueger | |
| 5,057,344 | A | | 10/1991 | Mealey | |
| 5,077,921 | A | | 1/1992 | Mooney | |
| 5,174,054 | A | | 12/1992 | Politi | |
| 5,294,279 | A | | 3/1994 | Kuhns et al. | |
| 5,383,293 | A | | 1/1995 | Royal | |
| 5,483,762 | A | | 1/1996 | Hogan | |
| 5,806,223 | A | | 9/1998 | Visagie | |
| 5,896,690 | A | | 4/1999 | Suesholtz | |
| 5,918,398 | A | | 7/1999 | Stanley et al. | |
| 6,025,040 | A | | 2/2000 | Brockley | |
| 6,039,495 | A | | 3/2000 | Zimmerman et al. | |

* cited by examiner

*Primary Examiner*—Cassandra H. Davis
(74) *Attorney, Agent, or Firm*—Mills Law Firm PLLC

(57) ABSTRACT

A picture frame for displaying a picture and shadowbox articles includes a preformed mat system having a frontal two-ply photomat with two bordered openings. One opening is covered with a desired picture and the other opening is aligned with a backing assembly carrying a shadowbox for displaying an associated solid object. The components may be packaged in kit form for use by individuals without special tools or prior framing experience.

14 Claims, 3 Drawing Sheets

PICTURE FRAME WITH PICTURE AND SHADOWBOX MAT SYSTEM

FIELD OF THE INVENTION

The present invention relates to matted picture frames and, in particular, to a mat system for picture frames for displaying planar and solid renderings.

BACKGROUND OF THE INVENTION

Matted picture frames for displaying pictures on two dimensional lamina such as photographs, paintings and other scenes are widely available in differing frame materials and mat finishes. The completed frames may be fashioned by professions or assembled without undue effort by individuals. The picture frame mounting of three dimensional objects poses a greater difficulty and generally requires a custom made shadowbox providing a projecting or recessed container that is specially adapted for mounting on a selected picture frame. Previous attempts at mixed media presentations of pictures and solid objects has required professional assistance to properly integrate the desired display content into a picture frame of choice. Such an approach is limitedly available, time consuming, and costly.

To provide greater choices to consumers, various systems have been proposed for using preformed materials for planar and solid objects. In U.S. Pat. No. 5,025,579 to Krueger, a preformed matting and picture frame is disclosed for displaying pictures. The construction is based on plastic laminates and framing elements, thereby excluding traditional frames and matting components preferred by consumers.

U.S. Pat. No. 5,806,223 to Visagie discloses a one-piece plastic molded shadowbox for incorporation into a selected mounting frame. The shadowbox does not accommodate conventional matting aprroaches or cojoint presentation of pictures.

A further preformed shadowbox is disclosed in U.S. Pat. No. 4,286,400 to MacPherson et al. discloses plural molded components that may be interfitted to capture an article for display in a prescribed format.

Accordingly, a need persists for a flexible framing and matting system allowing conventional selections of frames and mats to be utilized for the joint display of pictures and associated articles in a system that may be readily accomplished by professionals and lay personnel without the need for extensive dedicated, costly and aesthetically limiting components, and without requiring special skills or equipment for assembly.

BRIEF SUMMARY OF THE INVENTION

The present invention provides a matting system for use with conventional picture frames for cojointly displaying selected pictures and associated objects using widely accepted materials and designs. The invention may be provided in kit form for direct use by individuals without prior knowledge of mat cutting, picture framing or shadowbox making. The matting system comprises a two-piece mat assembly of conventional photomat materials having preformed openings to establish a picture field and a shadowbox field. A desired picture such as a photograph or painting may be attached to the mat assembly for presentation in the picture field. The mat system includes a backing assembly carrying a shadow box, either as an integrated component or a separate piece, that is aligned with the shadowbox field and may be used for displaying memorabilia associated with the picture. The resulting assembled lamina may be mounted in the existing rear rabbet on the picture frame and connected with appropriate fasteners. The system may be used in conjunction with a transparent front panel for displaying the artistic association using consumer selected materials and frames associated with quality picture framing. The mat system can be incorporated in kit form, allowing individuals without prior framing and matting experience to design a custom presentation without professional assistance.

Accordingly, it is an object of the present invention to provide a mat system for picture frames for cojointly presenting pictures and solid articles.

Another object of the invention is to provide a kit for use by non-professional having components of conventional material enabling assembly of a picture and shadow box display without prior experience.

A further object of the invention is to provide a mat system for conventional picture frames having a conventional matted display of pictures and three dimensional objects.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
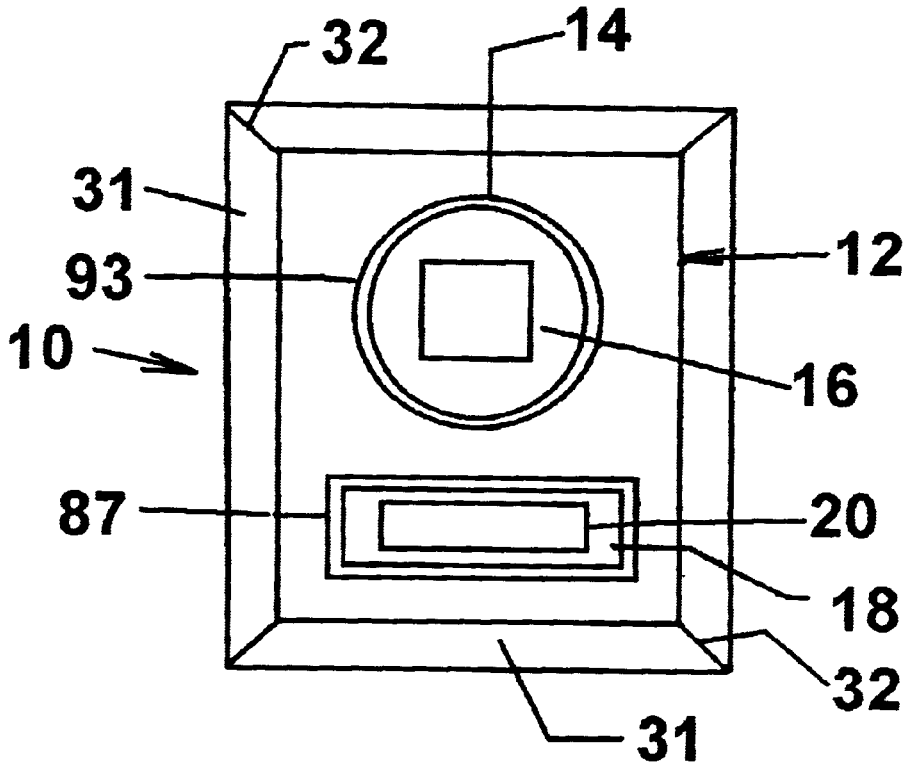
FIG. 1 is a front elevational view of a picture frame assembly including a mat system in accordance with a preferred embodiment of the invention.

Referring to the drawings for the purpose of describing the preferred embodiment and not for limiting same, FIG. 1 illustrates a picture frame assembly 10 including a mat system 12 for displaying in an upper picture field 14 a two dimensional picture 16 and for displaying in a lower shadowbox field 18 a three dimensional solid object 20. The picture frame assembly 10 is provided with a rear mounting assembly, not shown for mounting on a vertical surface.

Figure 2:
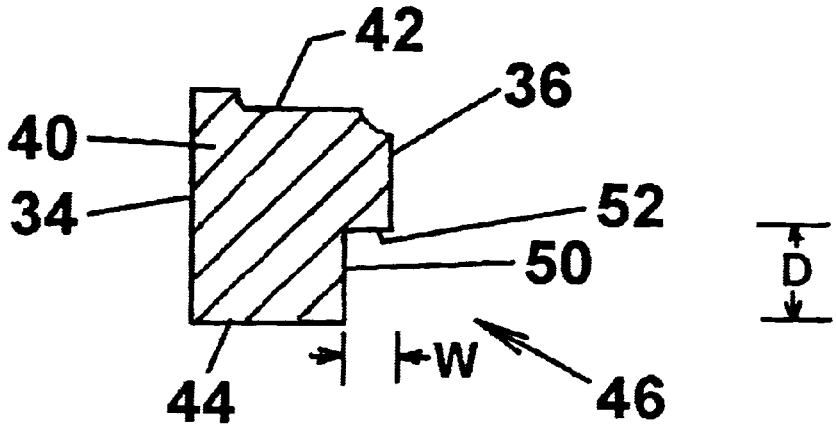
FIG. 2 is a cross sectional view of the frame molding.

The picture frame assembly 10 comprises a peripheral frame 30 having moldings 31 conventionally interconnected at miter joints 32. The moldings 31 have outer surfaces 34 defining a rectangular outer profile and inner surfaces 36 defining a rectangular frontal opening for frontally displaying the mat system 12. The picture frame assembly 10 may be selected from existing frames or conventionally constructed from framing elements widely commercially available in a wide variety of materials, cross sectional details and decorative finishes. Each molding 31, as shown additionally in FIG. 2 is defined in cross section by a body 40 defined by the outer surface 34, the inner surface 36, a decoratively profiled front surface 42 and a rear surface 44 including a recessed rabbet 46 for reception, mounting and securing of the mat system 12. The rabbet 46 is defined by an outer surface 50 spaced outwardly of the inner surface 34 and normal to the rear surface 44 and having a depth "D", and a mounting surface 52 parallel to the rear surface 44 and having a width "W". In conventional fashion, the rabbet 46 has sufficient depth for retaining the overall thickness of the mat system, a width sufficient for nesting and vertically and horizontally aligning the mat system, and sufficient access for allowing capture of the mat system 12 by conventional fasteners, not shown.

Figure 3:
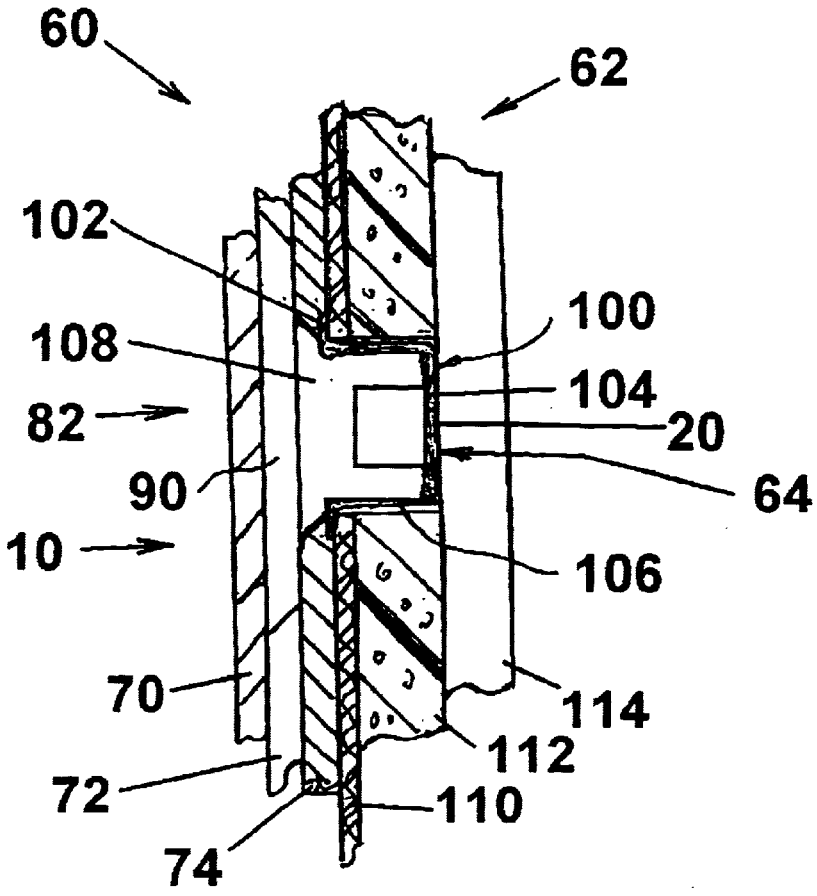
FIG. 3 is a fragmentary cross sectional view taken along line 3—3 in FIG. 1.
Figure 4:
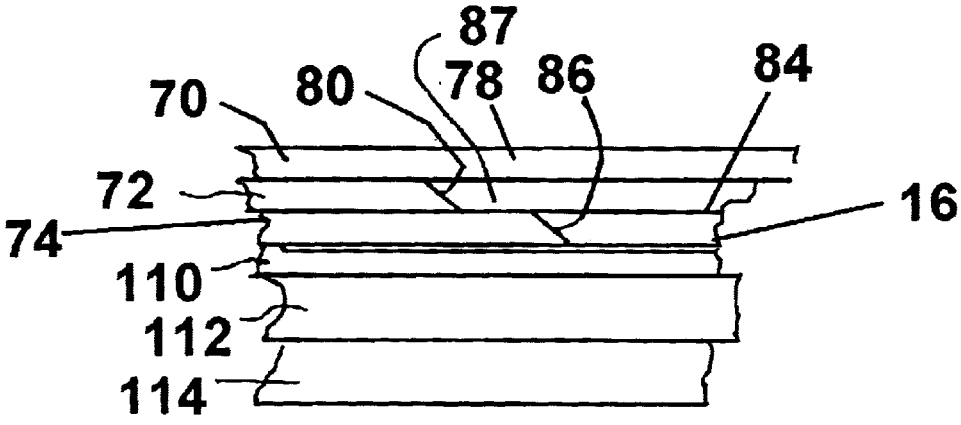
FIG. 4 is a fragmentary cross sectional view taken along line 4—4 in FIG. 1.
Figure 5:
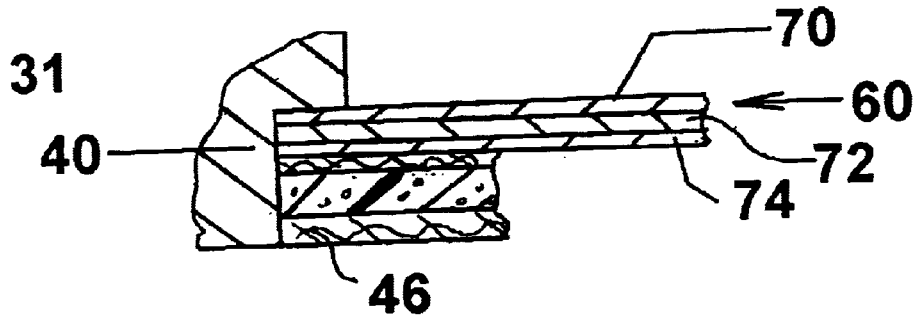
FIG. 5 is a fragmentary cross sectional view taken along line 5—5 in FIG. 1.

Referring to FIG. 3, the mat system 12 comprises a front mat assembly 60 and a rear backing assembly 62 carrying a shadowbox 64. The frontal mat assembly 60 includes a frontal transparent pane 70, a front mat 72, and a secondary mat 74. Depending on consumer preference, the pane 70 and the secondary mat 74 are optionally provided. The mats 72, 74 are formed of conventional commercially available photomat materials generally having a decorative front finish and a cross section that may be cut, bevelled or otherwise shaped to define the outer peripheral configuration and the opening for the fields 14 and 18. Referring additionally to FIG. 4, the front mat 72 has a portrait opening 78 defined by inner surface 80 and registering with the portrait field 14, and a shadowbox opening 90 defined by beveled surface 91 registering with the shadowbox field 18. The secondary mat 74 has an portrait opening 84 defined by an inner surface 86 registering with the portrait field 14 and proportionately smaller and concentric with the inner surface of the front mat 72 to define a decorative three dimensional border 87 around the picture field 14. The secondary mat 74 has a shadowbox opening 94 defined by an beveled inner surface 96 registering with the shadowbox field 18 and proportionately smaller and concentric with the inner surface of the front mat 72 to define a decorative three dimensional border 98 around the shadowbox field. In assembly as shown in FIG. 5, the mat assembly 30 will have an overall thickness less than the depth of the rabbet 46 to enable, in combination with the thickness of the rear backing assembly 62, secure mounting in the frame 30.

The shadowbox 64 comprises a frontally opening rectangular receptacle 100 frontally terminating with an outwardly turned peripheral flange 102. The shadowbox 64 may be fabricated as a single piece or in multiple components from suitable rigid or semi-rigid materials. A one-piece plastic molding if preferred. The flange 102 is relatively thin to permit positioning between the front assembly and the backing assembly without noticeable contouring therearound. A thickness of around 0.100 inch or less is preferred. The receptacle 100 has a rear wall 104 spaced from the flange 102 by about the thickness of the rear backing assembly 62 so as not to project beyond the rear surface in mounted position. However, as explained in greater detail below, the receptacle may be incorporated into the front layer of the backing assembly or project beyond the rear surface to accommodate mounting in various framing materials. The receptacle 100 includes peripheral side walls 106 outwardly defining a generally rectangular cross section for receipt in the backing assembly as described below. The inwardly facing surfaces of the rear wall and side walls define a mounting cavity for reception and display of three dimensional objects 20 in the shadowbox field 18. The side walls are complementary in shape to the openings in the front mat 72 and secondary mat 74 whereby the flange 102 is masked by or limitedly visible.

The rear backing assembly 62 comprises a front spacer 110 and a rear spacer 112 and backing plate 114, each having a outer rectangular shape for telescopic nesting in the rabbet. The front spacer 110 preferably constitutes a minor portion of the thickness of the backing assembly. The front spacer 110 is provided with a rectangular opening 116 for slidingly accommodating the receptacle and registering with the openings in the front mat 72 and secondary mat 74. The front spacer may be formed of cardboard or similar material. The rear spacer 112 has a rectangular opening 118 for slidingly accommodating the receptacle 100 and registering with the openings 90 and 108. The rear spacer 112 constitutes the major thickness of the backing assembly 62. The rear spacer 112 may be formed of a light weight material such a expanded polystyrene. In final assembly, the rear spacer is covered by the backing plate 114.

In assembly, the planar rendering in the form of a photograph, painting, commemoration or like visual content presentation is carried on a thin planar carrier sheet appropriate therefor. The planar rendering may have a varying size larger than the openings in the mat assembly for proper visual and artistic presentation. The planar rendering may be sandwiched between the mat assembly 60 and the backing assembly 62. Preferably, the planar rendering is adhesively tacked to the rear surface of the secondary mat 74.

The solid rendering housed in the shadowbox 64 may be any solid object 20 receivable in the cavity and is preferably an article have an artistic, symbolic or other memorabilia association with the planar rendering. Examples might include an infant picture and a baby spoon, a wedding photograph and a bridal garter, a graduation picture and a tassel or any other association the purchaser desires to establish. Such objects may also be supplemented with other decorative material. The contents in the cavity of the shadowbox may be mechanically or adhesively supported in position or loosely received therewithin.

For assembly, after having selected the desired materials for the frame and mat system, the mat system is assembled by taping the planar rendering 16 to the rear surface of the secondary mat 74 in desired alignment within the opening. The object 20 is glued in desired location in the cavity 108 of the shadowbox 64. The various laminae of the mat system are then serially assembled beginning with the backing plate 114 and concluding with the front mat 72. The frame 30 is positioned with the rear surface facing upwardly and the rabbet 46 exposed. If a glass or translucent front pane 70 is desired, the same is positioned in the rabbet as the frontal lamina. The mat system 12 is then inverted and telescoped within the rabbet 46, the components mechanically secured by conventional push-in fasteners, and an optional dust cover installed along with any required suspension systems. In presentation, the frame assembly will be substantially flush with the mounting surface with the portrait field and the shadowbox field displaying their associated rendering in the desired context.

The system described above is particularly suited for frames having a rabbet with a depth or around 1 inch or greater. This accommodates twin layers of conventional photomat, 0.125 or less layer for the front spacer and backing and a 0.625 for the rear spacer. In frames where a lesser rabbet depth is available, the backing plate 114 may be deleted and the rear spacer 112 removed after subassembly. Accordingly, the base wall of the shadowbox may project beyond the rear surface of the frame and engage the mounting surface. Such orientation and loading generally will not impose any undue constraints on the presentation, contents or mounting. The shadowbox 64 may also be integrated with the front spacer to form a single unit.

Figure 6:
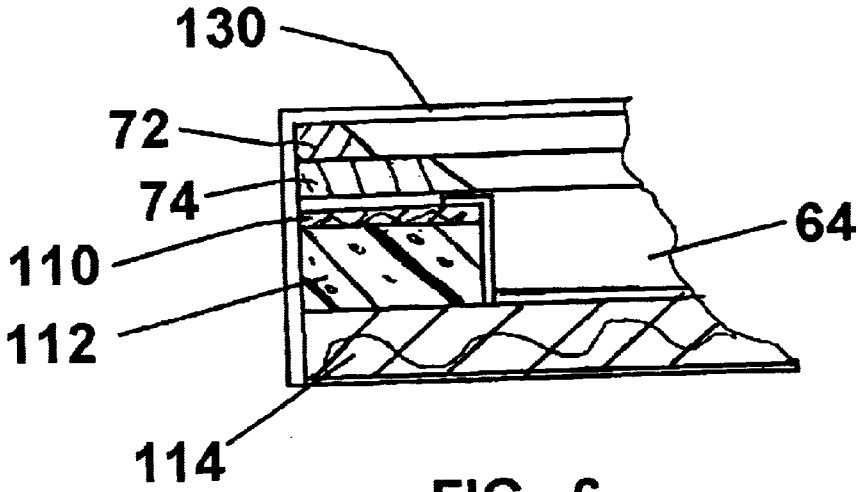
FIG. 6 is a fragmentary cross sectional view of a kit for the mat system.

From the foregoing, it will be apparent that the prospective purchaser, starting with readily available materials in kit form, may personally or with third party services, select mat surfaces, framing materials, viewing field shapes and orientations, and renderings personalize a framed presentation. As shown in FIG. 6, the components including a the front mat 72, the secondary mat 74, the shadowbox 64, the front spacer 110, the rear spacer 112 and the backing plate 114 may be packaged in unitized form in a container 130, such as a packing carton or shrink wrapping. Accessory components such as fasteners, picture wire, and hooks may be included along with enabling instructions. Preferably, the kits would be available in popular framing sizes with circular, rectangular, oval, and similar openings for the desired integration of the two-dimensional and three dimensional fields.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A mat system for a picture frame having a central opening and rearwardly and a inwardly opening rabbet peripherally surrounding the opening, said mat system comprising: a frontal mat member slidably receivable within the rabbet and having first opening defining a first field and adapted to retain at a rear surface thereof a planar rendering thereon for viewing through the central opening in the first field, said frontal mat member having a second opening spaced from said first opening defining a second field; a rear backing member slidably receivable within the rabbet having a frontally opening rearwardly extending cavity for containing a rendering in solid format registering with said second opening in said mat member and having a frontal peripheral surface engagable with said rear surface of said mat member, said backing member additionally including a slot registering with said second opening in said mat member, a receptacle having wall surfaces defining said cavity slidably received in said slot, said receptacle terminating with an outwardly turned peripheral flange engaging a front surface of said backing member, whereby a visual presentation may be effected a said fields by said renderings disposed for viewing in said first opening and said cavity.

2. The mat system as recited in claim 1 wherein said picture frame includes a transparent panel disposed in the rabbet and engaged by the front surface of said mat member.

3. The mat system as recited in claim 1 wherein said mat member includes first and second mat lamina.

4. The mat system as recited in claim 3 including a second backing member having a slot registering with said slot in said first backing member.

5. The mat system as recited in claim 4 wherein said second backing member is formed of a light weight foamed material.

6. The mat system as recited in claim 5 wherein said foamed material is expanded polystyrene.

7. The mat system as recited in claim 5 including a third backing material receivable in the rabbet and having front surface engaging the rear surface of one of said first backing member or said second backing member.

8. The mat system as recited in claim 4 wherein the thickness of said first backing member and said second backing member is greater than the depth of said cavity.

9. The mat system as recited in claim 4 wherein the combined thickness of said mat member and said backing member is less than about the depth of the rabbet in the frame member.

10. The mat system as recited in claim 4 wherein the thickness of said mat member and the depth of said cavity is greater than the depth of the rabbet whereby said cavity rearwardly projects beyond the rear surface of the frame member.

11. In a picture frame having a peripheral frame having a rearwardly and inwardly opening groove bounding a central opening, a photograph and shadowbox mat assembly for displaying a planar rendering and a three dimensional rendering comprising: a first photomat member slidably receivable in said groove and having a picture opening for viewing said planar rendering and a shadowbox opening for viewing said three dimensional rendering; a second photomat member having a front surface engagable with said first photomat member, said second photomat member having a first opening registering with and proportionately smaller than said portrait opening and a second opening registering with said shadowbox opening, said second photomat member having a rear surface for positioning said planar rendering overlying said portrait opening; a shadowbox having sidewalls defining a rearwardly opening shadowbox cavity substantially registering with said second opening in said second photomat member and an outwardly turned peripheral flange; a rear backing slidably receivable in the groove of the frame member, said rear backing having a slot aligned with said three dimensional opening and slidably receiving said shadowbox with said flange engaging the front surface thereof and said cavity extending rearwardly beyond.

12. The mat system as recited in claim 11 including a second backing member having a slot registering with said slot in said first backing member.

13. The mat system as recited in claim 12 wherein said second backing member is formed of a light weight foamed material and including a third backing material receivable in the groove and having front surface engaging the rear surface of one of said first backing member or said second backing member.

14. A kit for displaying a planar object and a solid object in a picture frame having a rearwardly and inwardly opening groove comprising: container means including a first photomat member slidably receivable in said groove and having a portrait opening for viewing said planar object and a shadowbox opening for viewing said solid object, a second photomat member having a front surface engagable with said first photomat member, said second photomat member having a first opening registering with and proportionately smaller than said portrait opening and a second opening registering with said shadowbox opening, said second photomat member having a rear surface for positioning said planar rendering overlying said portrait opening, a shadowbox engaging said second photomat member having sidewalls defining a rearwardly opening shadowbox cavity substantially registering with said second opening in said second photomat member and an outwardly turned peripheral flange, and a rear backing, said rear backing having a slot aligned with said shadow and slidably receiving said shadowbox with said flange engaging the front surface thereof and said cavity extending rearwardly beyond.

* * * * *